US005131589A

United States Patent [19]

Sherrill

[11] Patent Number: 5,131,589

[45] Date of Patent: Jul. 21, 1992

[54] HUMIDIFIER

[76] Inventor: Gary W. Sherrill, 4107 Chestnut St., Fairfax, Va. 22030

[21] Appl. No.: 804,392

[22] Filed: Dec. 10, 1991

[51] Int. Cl.[5] ..... B01F 3/02

[52] U.S. Cl. ..... 236/44 A; 237/78 A; 126/113

[58] Field of Search ..... 237/2 R, 7, 8 A, 78 R, 237/78 A; 126/113; 236/44 R, 44 A

[56] References Cited

U.S. PATENT DOCUMENTS 2,094,906 10/1937 Schick ..... 237/78

*Primary Examiner*—Henry A. Bennet

*Attorney, Agent, or Firm*—Walter F. Wessendorf, Jr.

[57] ABSTRACT

A room humidifier in combination with a source of potable water and a source of heated fluidic material, such as a room hot water radiator, room steam radiator, room baseboard convector, remote steam boiler or remote hot water boiler. Potable water from its source is supplied to cover a heat exchanger in the humidifier to a desired level. Such potable water is heated by the heated fluidic material flowing through the heat exchanger, causing the formation of water vapor which collects within the humidifier. The desired relative humidity in the room is attained and maintained by control means which causes the flow of the heated fluidic material through the heat exchanger to form such water vapor and the control means causes a fan to operate to draw room air through the humidifier to render such room air moisture-laden and to blow such moisture-laden air into the room.

12 Claims, 7 Drawing Sheets 55
49
53
5
25
21
21
3
45
31
51
47
9
23
23
13
15
13
35
1

HUMIDIFIER

BACKGROUND OF THE INVENTION

1. Technical Field

This invention relates to a room humidifier that can be operatively connected to an existing supply line of potable water; and operatively connected to the supply and return lines of either a room hot water radiator, a room steam radiator, a room baseboard convector, or remotely to the supply and return lines of a hot water boiler or steam boiler.

2. Background

Human comfort is affected by the relative humidity in a room, also defined as the quantity of water vapor or moisture-laden air in such room. During cold weather, the air in a heated building is very dry and correspondingly the relative humidity is far too low, and consequently the health and comfort of the human occupants are affected by such low humidity. The problem of the art to which this invention apertains is the need for a room humidifier, described under "Technical Field" whereby a human occupant can control the relative humidity in a room so that the room is comfortable for all room occupants and their health is not affected.

SUMMARY OF THE INVENTION

Accordingly, the object of the invention is to Contribute to the solution of the discussed problem of the prior art by providing a room humidifier that is operatively connected to an existing supply line of potable water; and operatively connected to the supply and return lines servicing either the hot water radiator in the room, the steam radiator in the room or the baseboard convector in the room, or operatively connected remotely to the hot water boiler itself or the steam boiler itself.

BRIEF DESCRIPTION OF THE DRAWINGS

This object and other objects of the invention should be discerned and appreciated by the detailed description of the preferred embodiment taken in conjunction with the drawing figures, wherein like reference numerals refer to similar elements throughout the several views, in which.

DETAILED DESCRIPTION OF THE PREFERRED EMBODIMENT

Figure 1:
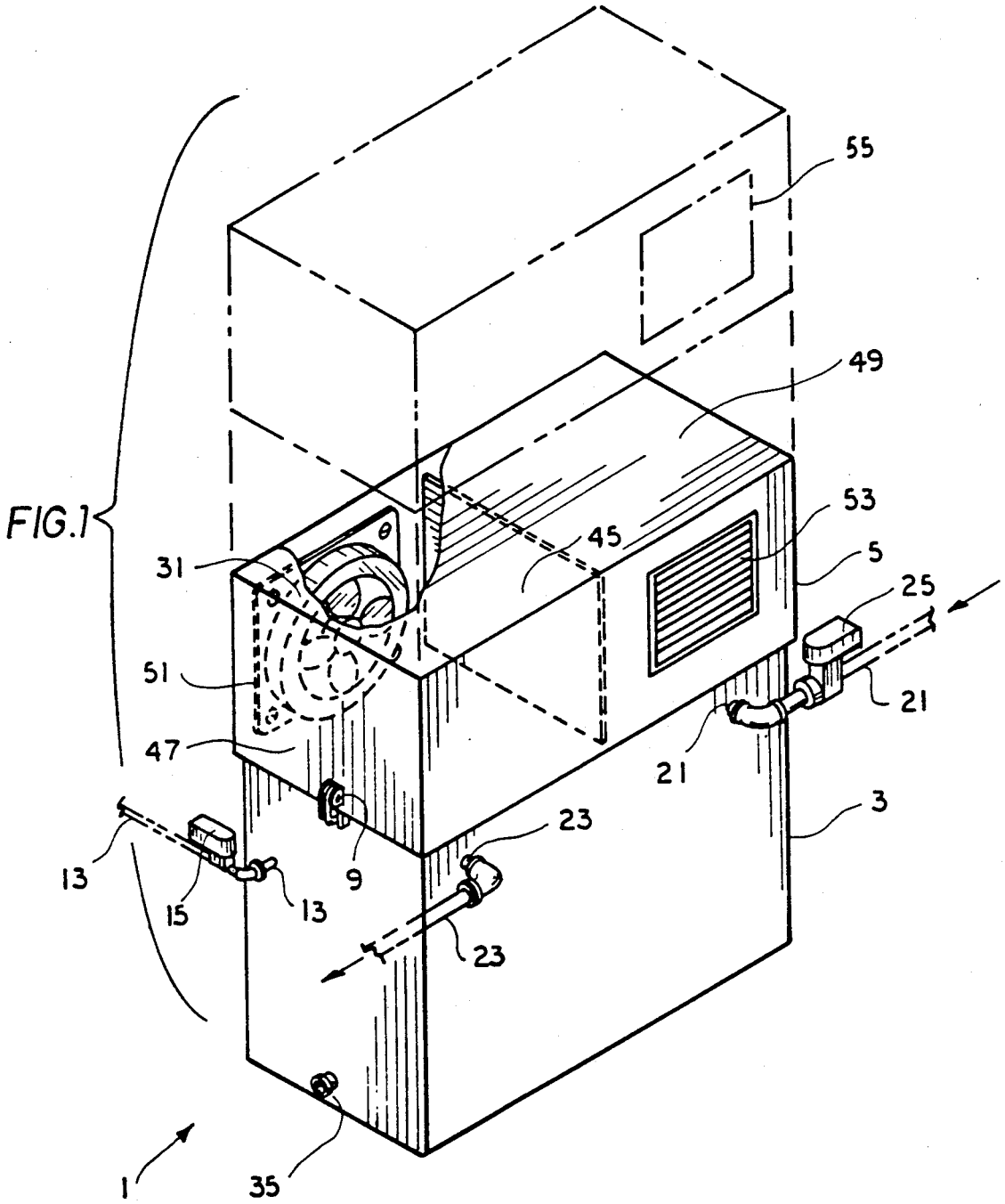
FIG. 1 is a perspective view of the room humidifier.
Figure 2:
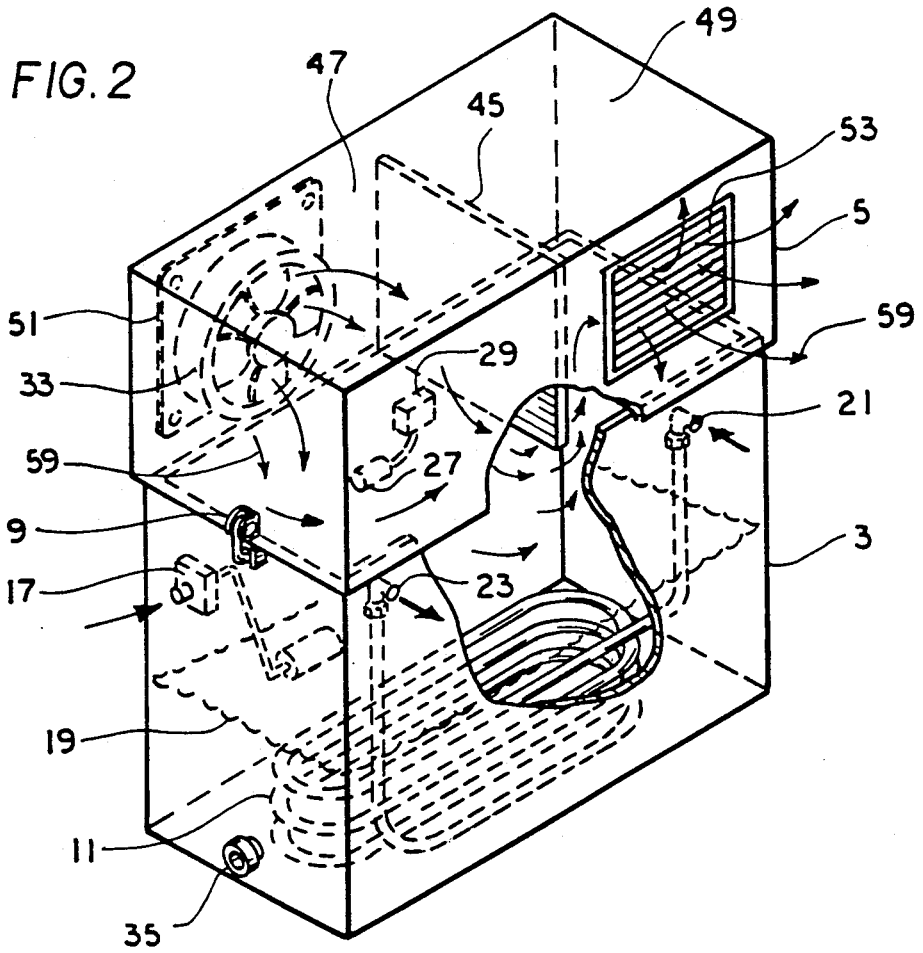
FIG. 2 is a perspective view, partly broken away, of the room humidifier.
Figure 3:
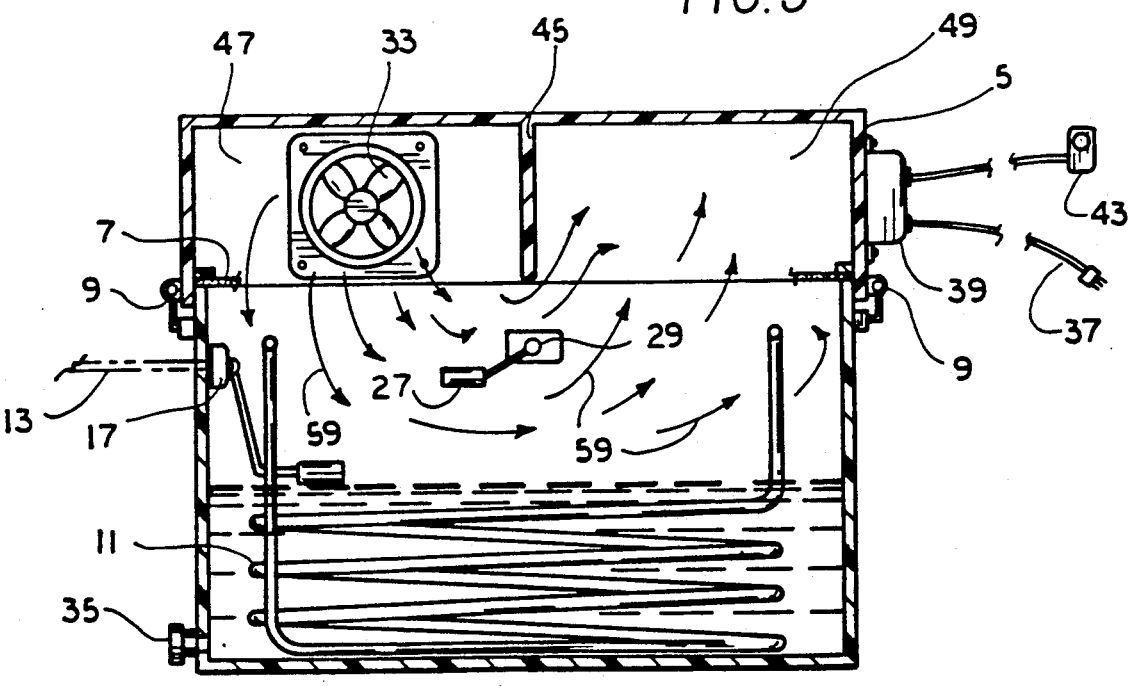
FIG. 3 is a sectional view of the room humidifier.

In FIG. 1 of the drawings, reference numeral 1 generally refers to the humidifier. With further inclusive reference to FIGS. 2 and 3, the room humidifier 1 has a lower sump section 3 and a top cover section 5. The top cover section 5 fits over and upon the lower sump section 3, as shown, and peripherally seals the lower sump section 3 by a gasket 7 interposed therebetween. The top cover section 5 is removably secured to the lower sump section 3 via latches 9. Housed within the lower sump section 3, as shown, is a heat exchanger 11. Potable water is supplied to the lower sump section 3 from an existing supply line 13 running through an inline 24 VAC solenoid controlled valve 15. An inline automatic mechanical control valve 17 controls and maintains the level 19 of the potable water in the lower sump section 3 at approximately ½" above the uppermost part of the serpentine-Configured portion of the heat exchanger 11, as shown. Hot water or steam is supplied to the heat exchanger 11 via the supply line 21 with respective hot water or steam from the heat exchanger 11 being returned via the return line 23. An inline 24 VAC solenoid controlled valve 25 controls the supply of hot water or steam to the heat exchanger 11. In the event the potable water in the lower sump section 3 rises above the desired water level, indicated by reference numeral 19, a mechanical float mechanism 27, operative incorporated with a high-water level 24 VAC cut-off switch 29, rises to actuate the switch 29 to open the 24 VAC circuit to both the 24 VAC controlled valves 15 and 25, thereby closing valves 15 and 25 to shut off the supplies of potable water flowing to the lower sump section 3 and hot water or steam flowing to the heat exchanger 11, respectively, as well as de-energizing the 24 VAC fan relay 31 to open the 120 VAC circuit to the fan 33.

Preparatory to cleaning or otherwise servicing the lower sump section 3, a removable drain plug 35, is removed to drain the potable water from the lower sump section 3, with subsequent access to the lower sump section 3 afforded by simply unlatching the latches 9 for removal of the top cover section 5.

A 120 VAC power supply lead 37, leading to a junction box 39, supplies electrical power to the fan 33 and to a 24 VAC step-down transformer 41. The junction box 39 is mounted on the top cover section 5, as shown, and houses the 24 VAC step-down transformer 41 and 24 VAC fan relay 31.

Figure 8:
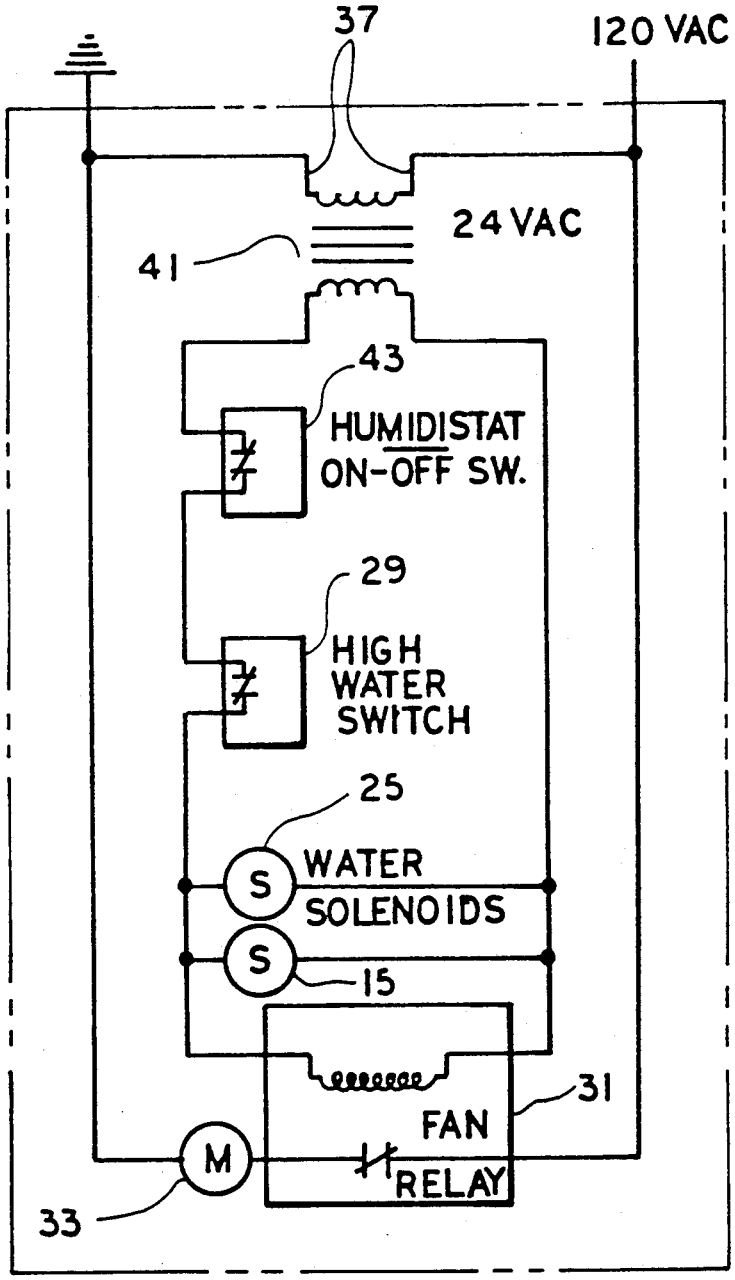
FIG. 8 is a block diagram of the 120 VAC and 24 VAC circuits, the components and controls.

A wall-mounted 24 VAC humidistat 43 is settable to control the desired relative humidity to be maintained in the room. With reference to FIG. 8, when the relative humidity in the room is less than that desired, the switch contacts of the humidistat 43 close to complete the 24 VAC circuit through the high-water switch 29 and the solenoids controlling respective valves 25 and 15 to energize the fan relay 31; and, when such desired relative humidity in the room has been attained, the switch contacts of the humistat 43 open to open the 24 VAC circuit.

An integral partition 45, vertically depending from the top wall of the top cover section 5, separates the interior of the top cover section 5 into an inlet chamber 47 and an outlet chamber 49. The fan 33 is mounted with respect to an inlet air opening 51, provided in a lateral wall of the top cover section and communicating with the inlet chamber 47. An air outlet grille 53 is exteriorly mounted with respect to an outlet air opening 55, provided in an opposite lateral wall of the top cover section 5 and communicating with the outlet chamber 49.

When the relative humidity in the room is less than that which is desired and that was pre-set by the control knob 57 of the humidistat 43, the switch contacts of the humidistat 43 close to complete the 24 and 120 VAC circuits. Hot water or steam, flowing through the supply line 21 to the heat exchanger 11 and returning therefrom via the return line 23, heat the potable water in the sump section 3, to cause a discrete rise in its temperature at which velocity is imparted to its molecules, some of which become great enough to carry through the water level 19 of the potable water and into the inlet and outlet chambers 47 and 49 where they become water vapor or moisture-laden air. Such described phenomenon is called evaporation. Operation of the fan 33 causes room air, as indicated by the directional flow arrows 59, to be drawn into the inlet chamber 47, then downwardly to the water level 19, around the bottom of the partition 45 and upwardly into the outlet chamber 49 in the movement of which the room air picks up moisture from such moisture-laden air, and thence through the air outlet grille 53 into the room, thereby increasing the relative humidity in the room. When the desired relative humidity is attained, the switch contacts of the humidistat 43 open to open the 24 VAC and 120 VAC circuits.

The humidifier 1 can be placed free-standing on the floor of the room in which it operates and in spaced relationship from the room wall immediately adjacent. FIGS. 4–7 show the humidifier 1 wall-mounted above the floor. Any appropriate conventional means (not shown), such as wall brackets, can be employed to mount the humidifier 1 above the floor and in spaced relationship from the room wall immediately adjacent.

Figure 4:
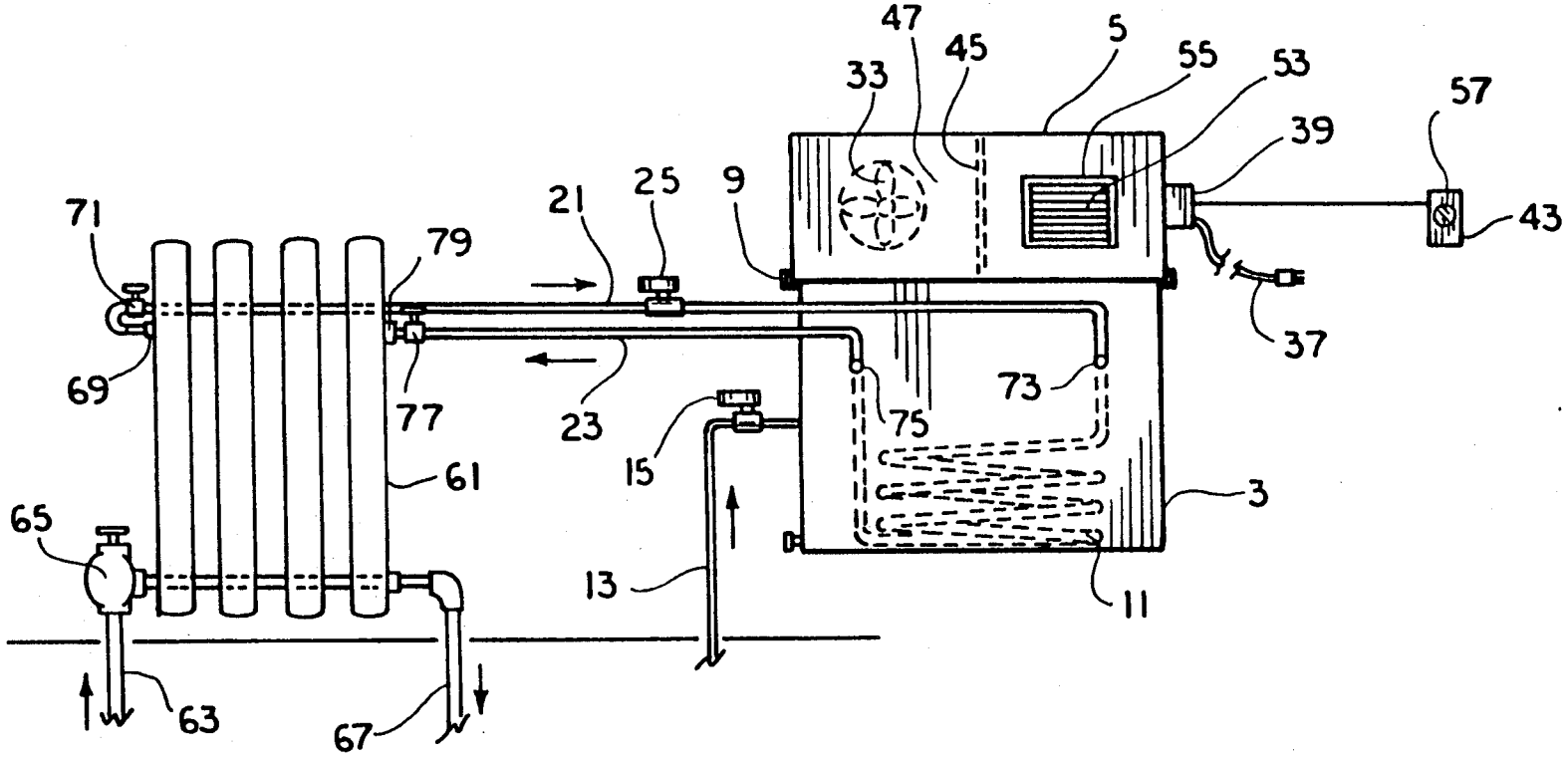
FIG. 4 is a view showing the room humidifier operatively connected to a supply line of potable water and to a room radiator.
Figure 5:
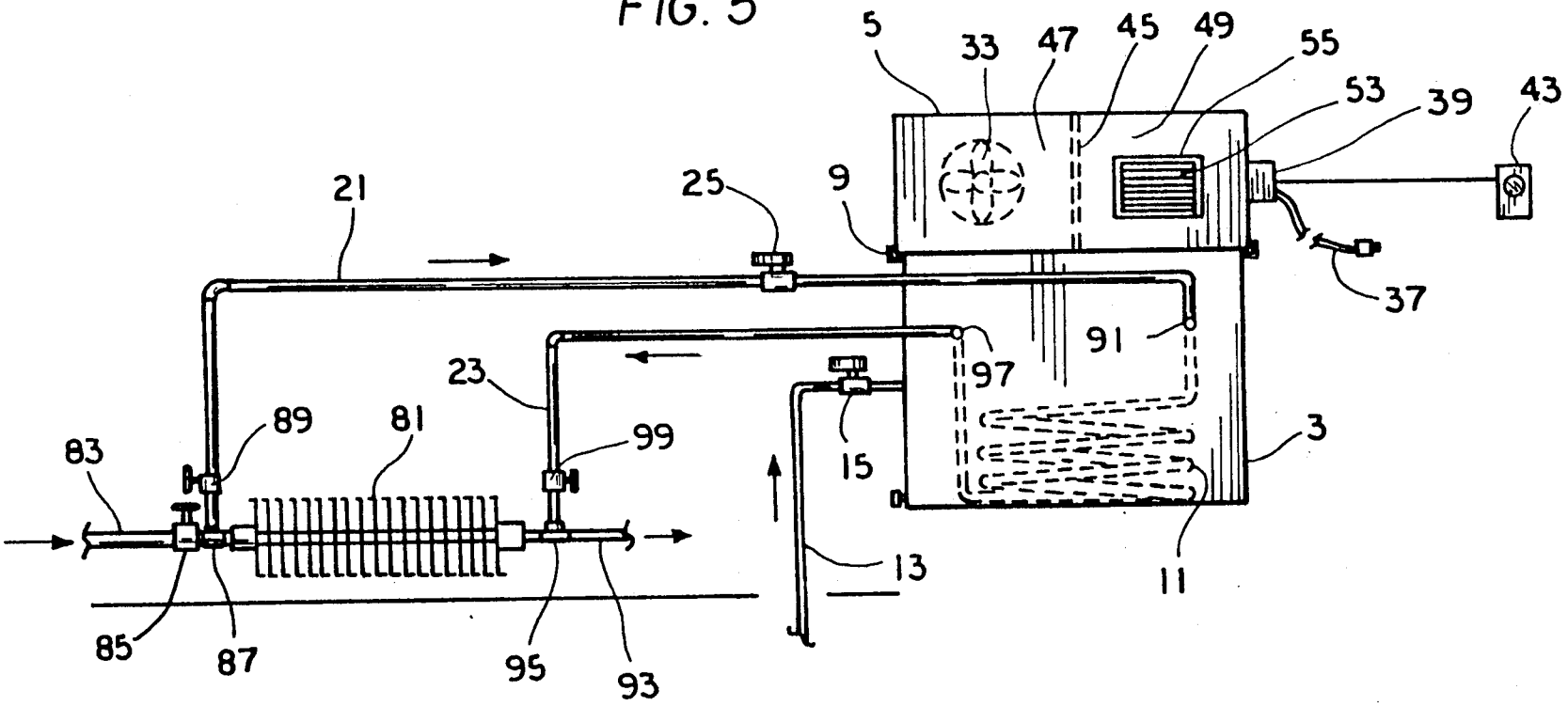
FIG. 5 is a view showing the room humidifier operatively connected to a supply line of potable water and to a room convector.
Figure 6:
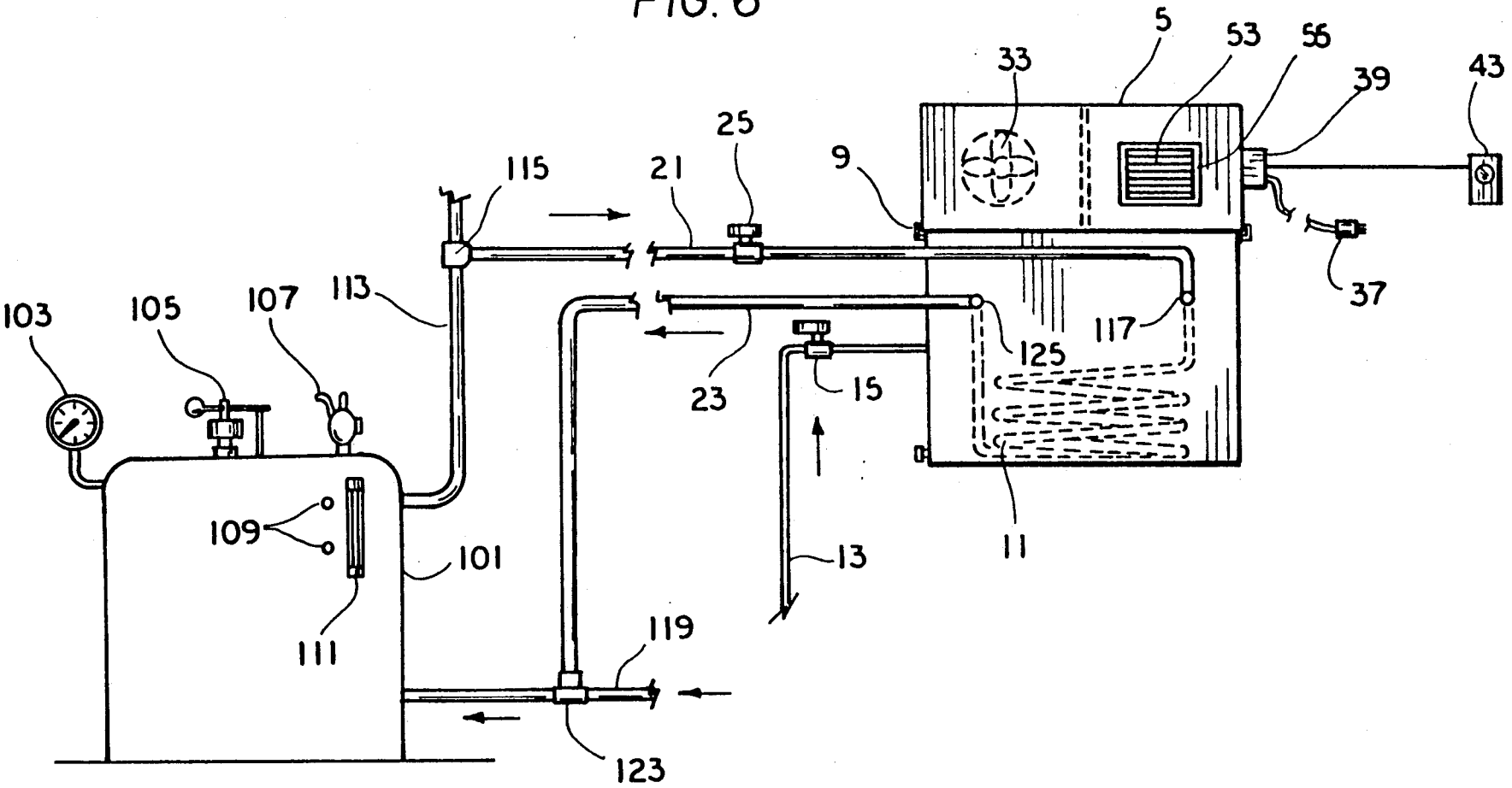
FIG. 6 is a view showing the room humidifier operatively connected to a supply line of potable water and operatively connected to a remote conventional steam boiler.
Figure 7:
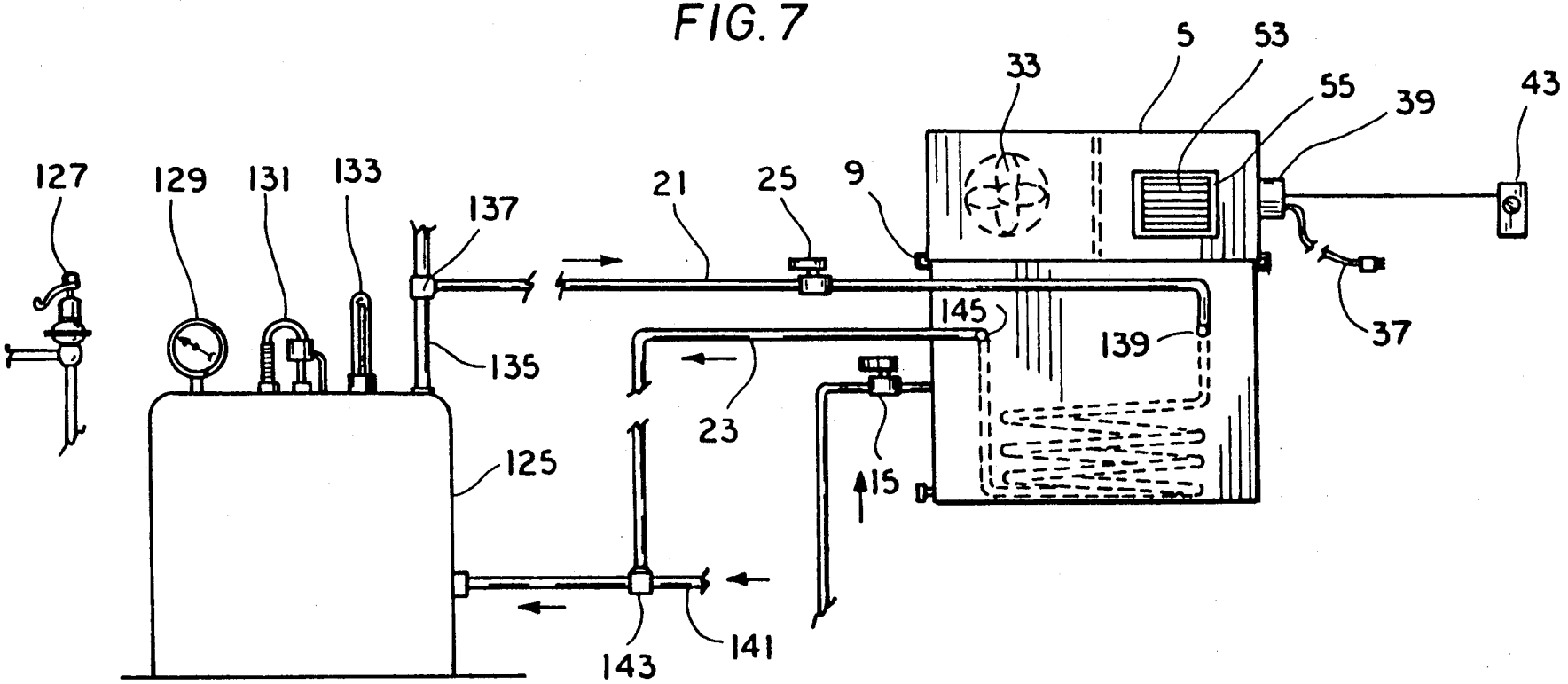
FIG. 7 is a view showing the room humidifier operatively connected to a supply line of potable water and operatively connected to a remote conventional hot water boiler.

In FIG. 4, the humidifier 1 is shown operatively connected to a conventional room hot water or steam radiator 61. Supply to the radiator 61 is provided by a supply line 63 through an inline control valve 65; and return from the radiator 61 is provided via a return line 67 elbow-connected at the radiator 61. The supply line 21, connected to the radiator 61 via fitting 69, runs through inline control valves 71 and 25 to the heat exchanger 11 where it is appropriately connected as indicated at 73. The return line 23, appropriately connected to the heat exchanger 11 as indicated at 75, returns to the radiator 61 through an inline control valve 77 and terminates with its connection to the radiator 61 via fitting 79. In FIG. 5, the humidifier 1 is shown operatively connected to a conventional room baseboard convector 81. Supply to the convector 81 is provided by the supply line 83, connected at its terminal end to the convector 61, with the supply line 83 running through an inline control valve 85 and the connected run openings of a tee 87. The supply line 21, connected to the outlet opening of the tee 87, runs through the inline control valves 89 and 25 to the heat exchanger 11 where it is appropriately connected as indicated at 91. Return from the convector 81 is provided via a return line 93, connected at the convector 81 and running through the connected run openings of a tee 95. The return line 23, appropriately connected to the heat exchanger 11 as indicated at 97, returns to the convector 81 through an inline control valve 99 and terminates with its connected outlet opening of the tee 95. FIG. 6 shows the humidifier 1 operatively connected remotely to a conventional steam boiler 101, having a pressure gage 103, a draft regulator 105, a safety valve 107, try cocks 109 and a gage glass 111. Supply from the steam boiler 101 is provided by a supply line 113 connected to the run openings of a tee 115. The supply line 21, connected to the outlet opening of the tee 115, runs through the inline control valve 25 to the heat exchanger 11 where it is appropriately connected as indicated at 117. Return to the steam boiler 101 is provided by a return line that runs through connected run openings of a tee 123 to the steam boiler 101. The return line 23 from the heat exchanger 11, appropriately connected thereat as indicated at 125, terminates with the connection of the return line 23 to the steam boiler 101 via the connected outlet opening of the tee 123. In FIG. 7, the humidifier 1 is shown operatively connected remotely to a conventional hot water boiler 125, having a relief valve 127, an altitude gage 129, a draft regulator 131 and a thermometer 133. Supply from the hot water boiler 125 is provided by a supply line 135 connected to the run openings of a tee 137. The supply line 21 to the heat exchanger 11, connected to the outlet opening of the tee 137, runs through the inline valve 25 and is appropriately connected to the heat exchanger 11 as indicated at 139. Return to the hot water boiler 125 is provided by a return line 141 that runs through connected run openings of a tee 143 to the hot water boiler 125. The return line 23 from the heat exchanger 11, appropriately connected to the heat exchanger 11 as indicated at 145, terminates with its connection to the hot water boiler 125 via its connected outlet opening of the tee 143.

In pp. 2–5 of MECHANICS OF FLUIDS, First Edition, published by the International Textbook Company, Scranton, Penna., the author, Dr. Glenn Murphy, defines "fluidic material" as being inclusively "hot water" and "steam".

I claim:

1. A room humidifier in combination with a source of potable water and a source of heated fluidic material; said humidifier having a lower sump section, a heat exchanger, control means, a top cover section and a fan; said lower sump section receiving therein and housing said heat exchanger, said lower sump section being connected to and in communication with said Source of potable water to fill said lower sump section with potable water, said control means maintaining the potable/-water in said lower sump section to a desired vertical level above said heat exchanger, said lower sump section receiving said top cover section thereon in emplaced mounting relationship, said top cover section having an inlet air opening and an outlet air opening, said fan being mounted with respect to said inlet air opening, said source of heated fluidic material having supply and return lines in communication with said heat exchanger to provide said heated fluidic material to said heat exchanger, said heated fluidic material flowing through said supply line to said heat exchanger and, in return, flowing from said heat exchanger to said source of heated fluidic material, said heated fluidic material, in flowing through said heat exchanger, heating the potable water sufficiently to cause the formation of water vapor in the lower sump section above the water level above said heat exchanger and within said top cover section, said fan, upon its operation, drawing room air through said inlet air opening in said top cover section and forcing such room air out through said outlet air opening, thereby picking up such water vapor with such room air becoming moisture-laden, and with moisture-laden air forced into the room increasing the relative humidity of the room, said control means maintaining the humidity in the room at a pre-settable desired relative humidity, said control means causing the flow of said heated fluidic material through said heat exchanger to cause the formation of such water vapor and causing the fan to blow such moisture-laden air into the room, and said control means stopping the flow of said heated fluidic material and the operation of said fan when the desired relative humidity has been attained in the room.

2. The combination in accordance with claim 1, wherein said source of heated fluidic material is a room hot water radiator.

3. The combination in accordance with claim 1, wherein said source of heated fluidic material is a room steam radiator.

4. The combination in accordance with claim 1, wherein the source of heated fluidic material is a room baseboard convector.

5. The combination in accordance with claim 1, wherein said source of heated fluidic material is a steam boiler.

6. The combination in accordance with claim 1, wherein said source of heated fluidic material is a hot water boiler.

7. The combination in accordance with claim 1, wherein said top cover section has a depending vertical partition separating said top cover section into an inlet chamber and a outlet chamber.

8. The combination in accordance with claim 7, wherein said inlet air opening communicates with said inlet chamber and said outlet air opening communicates with said outlet chamber.

9. The combination in accordance with claim 8, wherein said top cover section has an air outlet grille in mounting relationship with said outlet air opening.

10. The combination in accordance with claim 1, wherein said control means includes humidistat means maintaining the humidity in the room at such desired relative humidity.

11. The combination in accordance with claim 1, wherein said control means includes high-water switch means to shut off the flow of potable water to said lower sump section when such water level rises above such desired vertical water level, to shut off the flow of said heated fluidic material to said heat exchanger and to cause said fan to cease operation.

12. The combination in accordance with claim 1, wherein said lower sump section has removable drain plug means for draining such potable water from said lower sump section; and said lower sump section and top cover section have cooperating latch means removably securing together said lower sump and top cover sections.

* * * * *